US008636018B2

(12) United States Patent
Kozuka et al.

(10) Patent No.: US 8,636,018 B2
(45) Date of Patent: Jan. 28, 2014

(54) MICROBUBBLE CLEANING SYSTEM FOR A LARGE PRODUCT SUCH AS A VEHICLE

(75) Inventors: Hiroshi Kozuka, Okazaki (JP); Masahiro Inoue, Nagoya (JP); Kanji Imura, Toyota (JP); Yuji Nemoto, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/581,031

(22) PCT Filed: Feb. 24, 2011

(86) PCT No.: PCT/IB2011/000563

§ 371 (c)(1),
(2), (4) Date: Aug. 24, 2012

(87) PCT Pub. No.: WO2011/104633

PCT Pub. Date: Sep. 1, 2011

(65) Prior Publication Data

US 2012/0312324 A1 Dec. 13, 2012

(30) Foreign Application Priority Data

Feb. 25, 2010 (JP) ..... 2010-040275

(51) Int. Cl.
*B08B 3/00* (2006.01)

(52) U.S. Cl.
USPC ..... 134/123; 134/1; 134/10; 134/102.2; 134/3; 134/30; 95/139; 95/236

(58) Field of Classification Search
USPC ..... 134/123
See application file for complete search history.

(56) References Cited

U.S. PATENT DOCUMENTS 7,993,432 B2 * 8/2011 Wright et al. ..... 95/139

FOREIGN PATENT DOCUMENTS

JP 6-212464 8/1994
JP 2007-301529 11/2007

OTHER PUBLICATIONS

JP 2007-301529 Machine Translation, Miyamoto et al., Nov. 22, 2007.*
Miyamoto et al., "Cleaning apparatus" (Machine Translation), JP 2007 301529, Nov. 2007.*
Iwai et al., "Cleaning device" (Machine Translation), JP 06 212464, Aug. 1994.*
M. Miyamoto et al., "Non-chemical Cleaning Technology by Utilizing Microbubble," vol. 81, No. 6, pp. 55-58 (2007).

(Continued)

*Primary Examiner* — Michael Barr
*Assistant Examiner* — Thomas Bucci
(74) *Attorney, Agent, or Firm* — Finnegan, Henderson, Farabow, Garrett & Dunner, LLP

(57) ABSTRACT

A microbubble cleaning system includes a tank in which a solution into which a product is immersed to clean the product is stored; supplying means for putting microbubbles into the solution and supplying the solution that includes the microbubbles into the tank; oil separating apparatus that collects bubbles that have risen to a surface of the solution stored in the tank as a result of cleaning the product, as well as a portion of the solution that is near the surface of the solution, in order to separate oil from the solution; generating means for generating a surface flow of the solution near the surface of the solution in order to remove the bubbles that have risen to the surface of the solution in the tank; and removing means for removing carbon dioxide from air that is used to generate the microbubbles by the supplying means.

5 Claims, 3 Drawing Sheets

(56) References Cited

OTHER PUBLICATIONS

International Search Report in International Application No. PCT/IB2011/000563; Mailing Date: Sep. 21, 2011.

Written Opinion of the International Searching Authority in International Application No. PCT/IB2011/000563; Mailing Date: Sep. 21, 2011.

* cited by examiner

MICROBUBBLE CLEANING SYSTEM FOR A LARGE PRODUCT SUCH AS A VEHICLE

CROSS-REFERENCE TO RELATED APPLICATIONS

This application is a national phase application of International Application No. PCT/IB2011/000563, filed Feb. 24, 2011, and claims the priority of Japanese Application No. 2010-040275, filed Feb. 25, 2010, the content of both of which is incorporated herein by reference.

BACKGROUND OF THE INVENTION

1. Field of the Invention

The invention relates to technology of a cleaning system that uses microbubbles to clean a large product such as a vehicle.

2. Description of the Related Art

Japanese Patent Application Publication No. 2007-301529 (JP-A-2007-301529) describes a cleaning apparatus that uses a microbubble cleaning method that is a cleaning method that increases the cleaning effect by using a cleaning solution and microbubbles.

The cleaning apparatus described in JP-A-2007-301529 includes a plurality of cleaning nozzles for spraying an object to be cleaned that has been immersed in a cleaning solution in a cleaning container, with a cleaning solution that includes microbubbles, an air blowing portion for amassing a surface oil film that floats on the surface of the cleaning solution, and an overflow tank and an oil separating portion that recovers the surface oil film and separates out the oil. This cleaning apparatus is compact, improves operability, and increases the life of the cleaning solution by further improving the cleaning effect of the microbubble cleaning method.

SUMMARY OF THE INVENTION

However, the apparatus described in JP-A-2007-301529 has several drawbacks. For example, 1) the apparatus described above is unable to be applied to a large product such as a vehicle. 2) Also, as the oil content increases, microbubbles are not able to be generated as easily due to the defoaming effect of the oil content, so the performance of the microbubbles is not able to be displayed. 3) Moreover, when normal air is supplied to an alkaline agent stored in the tank, the agent oxidizes from the carbon dioxide and the like in the air, such that the original performance of the agent is unable to be displayed. 4) In addition, a surfacant in the agent facilitates foaming (i.e., bubbling), and bubbles that have risen to the surface of the chemical solution do not easily disappear so they accumulate. If bubbles accumulate in the upper portion of the cleaning tank, these bubbles that include oil will end up adhering to the product again when the product is removed after cleaning.

Therefore, this invention provides a microbubble cleaning system for a large product such as a vehicle that can be applied to a large product such as a vehicle.

A first aspect of the invention relates to a microbubble cleaning system for cleaning a large product such as a vehicle. This cleaning system includes a cleaning tank in which a chemical solution into which the product is immersed to clean the product is stored; microbubble supplying means for putting microbubbles into the chemical solution and supplying the chemical solution that includes the microbubbles into the cleaning tank; an oil separating apparatus that collects bubbles that have risen to a surface of the chemical solution stored in the cleaning tank as a result of cleaning the product, as well as a portion of the chemical solution that is near the surface of the chemical solution, in order to separate oil from the chemical solution; surface flow generating means for generating a surface flow of the chemical solution near the surface of the chemical solution in order to remove the bubbles that have risen to the surface of the chemical solution in the cleaning tank; and carbon dioxide removing means for removing carbon dioxide from air that is used to generate the microbubbles by the microbubble supplying means. According to this structure, the cleaning performance can be improved when cleaning a large product such as a vehicle by adding microbubbles.

The cleaning system described above may also include circulating means for circulating the chemical solution by returning the chemical solution from which oil has been separated by the oil separating apparatus to the cleaning tank again. According to this structure, a chemical solution can be circulated by the circulating means and used again.

In the cleaning system described above, a plurality of delivery ports for supplying the chemical solution that includes the microbubbles by the microbubble supplying means may be densely provided on an inner wall surface of the cleaning tank in a location near a portion where the product is submerged into the stored chemical solution. According to this structure, when the product is immersed in the stored chemical solution, chemical solution that includes a high concentration of microbubbles can be made to flow into portions in the product structure that the chemical solution has difficulty getting into, so the cleaning performance in portions that the chemical solution has difficulty getting into can be improved.

In the cleaning system having the structure described above, the surface flow generating means may supply the chemical solution into the cleaning tank in a manner such that a portion of the chemical solution that is near the surface of the chemical solution flows toward the oil separating apparatus side. Also, the surface flow generating means may control the flow rate of the chemical solution that is supplied so as to increase from a center portion outward in a shorter direction of the cleaning tank.

A second aspect of the invention relates to a cleaning method for cleaning a large product such as a vehicle. This cleaning method includes: storing a chemical solution into which the product is immersed to clean the product in a cleaning tank; putting microbubbles into the chemical solution; supplying the chemical solution that includes the microbubbles into the cleaning tank; collecting bubbles that have risen to a surface of the chemical solution stored in the cleaning tank as a result of cleaning the product, as well as a portion of the chemical solution that is near the surface of the chemical solution, in order to separate oil from the chemical solution; generating a surface flow of the chemical solution near the surface of the chemical solution in order to remove the bubbles that have risen to the surface of the chemical solution in the cleaning tank; and removing carbon dioxide from air that is used to generate the microbubbles.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Next, example embodiments of the invention will be described with reference to the accompanying drawings. A microbubble cleaning system for a large product such as a vehicle (hereinafter simply referred to as the "cleaning system") according to an example embodiment is applied to a process for cleaning a body of a vehicle by a microbubble cleaning method as a process that precedes a process for painting the body of the vehicle, for example. Hereinafter, the structure of this cleaning system will be described in detail. Incidentally, the chemical solution in this example embodiment refers to an aqueous solution (a cleaning solution) of an agent in which a cleaning agent stock solution has been diluted with a predetermined amount of water at a predetermined dilution ratio.

Figure 1:
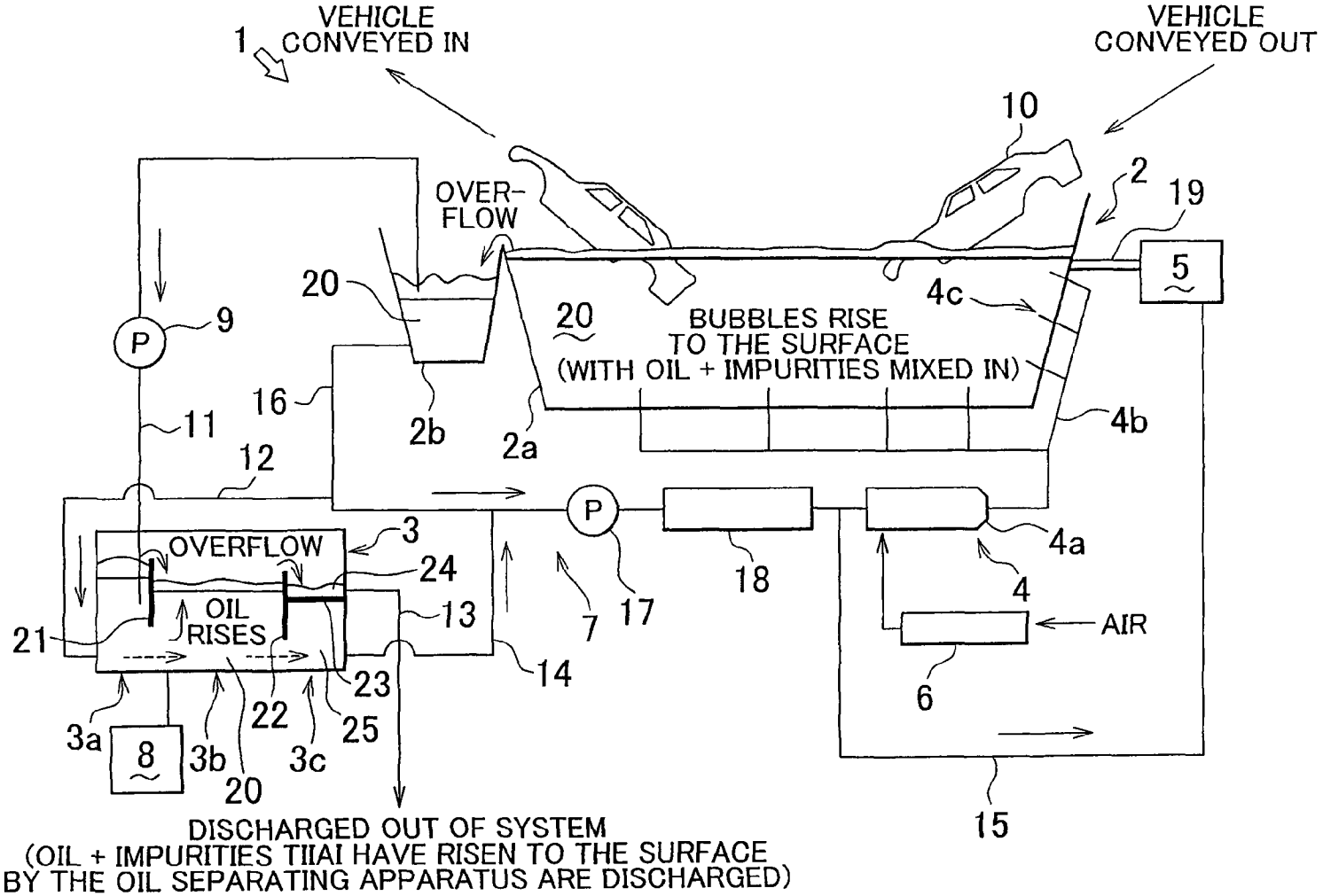
FIG. 1 is a view showing a frame format of the overall structure of a microbubble cleaning system according to an example embodiment of the invention.

A cleaning system 1 is a cleaning system of a chemical solution circulating system that cleans a body 10 of a vehicle (one example of a large product such as a vehicle) before a painting process by using a chemical solution 20 that includes microbubbles, and circulates the chemical solution 20 so that it can be used again. The cleaning system 1 mainly includes a cleaning tank 2, an oil separating apparatus 3, microbubble supplying means 4, surface flow generating means 5, a carbon dioxide removal device 6, and circulating means 7, as shown in FIG. 1.

The cleaning tank 2 in which a chemical solution (20) for cleaning the product by the product being immersed in the chemical solution (20) is stored, and includes a main tank 2*a* and a sub tank 2*b*. The main tank 2*a* is a large box-shaped tank with an open upper portion. The main tank 2*a* is able to hold a predetermined amount of chemical solution when cleaning the body 10. That is, the main tank 2*a* has a volume capable of holding enough chemical solution to immerse the entire body 10.

The sub tank 2*b* is a tank that is smaller than the main tank 2*a* and is arranged adjacent to one end of the main tank 2*a* in the longer direction. This sub tank 2*b* is a tank for holding the bubbles and chemical solution 20 that overflow from the adjacent end portion of the main tank 2*a*.

The oil separating apparatus 3 separates the oil from the chemical solution 20 by collecting the bubbles that have risen to the surface of the chemical solution 20 in the main tank 2*a* of the cleaning tank 2 from cleaning the body 10, as well as a portion of the chemical solution 20 near the surface of the chemical solution 20. That is, the oil separating apparatus 3 is an apparatus that separates the oil from the chemical solution 20 by collecting the bubbles collected in the sub tank 2*b* and a portion of the chemical solution 20 near the surface of the chemical solution 20 in the sub tank 2*b* by making them overflow from the end portion of the main tank 2*a*. The oil separating apparatus 3 includes the oil separating apparatus 3 main body and heating means 8. The separating apparatus 3 main body includes three tanks, i.e., a first separating tank 3*a*, a second separating tank 3*b*, and a third separating tank 3*c*, that are separated by predetermined partition walls, and is used to hold (i.e., store) the chemical solution 20 and separate the oil. The heating means 8 is used to heat the chemical solution 20 held in the oil separating apparatus 3 main body. A portion below a partition wall 21 that divides the first separating tank 3*a* from the second separating tank 3*b* is open, such that when the chemical solution 20 is stored in the oil separating apparatus 3 main body, the chemical solution 20 is able to flow via the opening below the partition wall 21 into the second separating tank 3*b* that is adjacent to the first separating tank 3*a*. Also, a portion below a partition wall 22 that divides the second separating tank 3*b* from the third separating tank 3*c* is open, such that when the chemical solution 20 is stored in the oil separating apparatus 3 main body, the chemical solution 20 is able to flow via the opening below the partition wall 22 into the third separating tank 3*c* that is adjacent to the second separating tank 3*b*.

The first separating tank 3*a* is connected to the sub tank 2*b* by a conduit 11 via a pump 9, such that the chemical solution 20 and the bubbles are able to be transferred from close to the surface of the chemical solution 20 that is stored in the sub tank 2*b* to the first separating tank 3*a* via the conduit 11 by driving the pump 9. Also, a conduit 12 that branches off from circulating means 7 that will be described later is connected to a lower portion of the first separating tank 3*a* (i.e., a lower portion at one end of the oil separating apparatus 3 main body). This conduit 12 is a conduit for introducing the chemical solution 20 from the circulating means 7 into the bottom in the oil separating apparatus 3 main body. Introducing the chemical solution 20 through the conduit 12 facilitates the flow of the chemical solution 20 in the longer direction of the oil separating apparatus 3 main body (i.e., in the direction of the dash arrows in FIG. 1) at the bottom inside the oil separating apparatus 3 main body.

The second separating tank 3*b* has a larger volume, and is also wider in the longer direction of the oil separating apparatus 3 main body, than the first separating tank 3*a* and the third separating tank 3*c* that are adjacent to the second separating tank 3*b* via the partition walls 21 and 22. This second separating tank 3*b* is a tank that is used to collect bubbles (that include oil and impurities and the like) that have accumulated on the surface of the chemical solution 20 stored in the adjacent first separating tank 3*a* and have flowed over the partition wall 21, as well as to store oil that has floated over when the chemical solution 20 flows in the longer direction of the oil separating apparatus 3 main body (i.e., in the direction of the dash arrows in FIG. 1).

The third separating tank 3*c* includes an upper tank 24 and a lower tank 25 that is separated from the upper tank 24 by a horizontal partition wall 23. The upper tank 24 is a tank that is used to store bubbles (that include oil and impurities and the like) that have accumulated on the surface of the chemical solution 20 stored in the adjacent second separating tank 3*b* and have flowed over the partition wall 22. Also, a conduit 13 is connected to the upper tank 24, such that the bubbles that include oil and impurities and the like that have been made to rise to the surface by the oil separating apparatus 3 can be discharged out of the system via this conduit 13. Meanwhile, the lower tank 25 is a tank that allows the inflow of the chemical solution 20 that flows along the bottom of the adjacent second separating tank 3*b*. Further, a conduit 14 that branches off from the circulating means 7 is connected to a lower portion of the third separating tank 3*c* (i.e., a lower portion at the other end of the oil separating apparatus 3 main body). This conduit 14 is a conduit for discharging the chemical solution 20 from the bottom of the oil separating apparatus 3 main body and returning it to the circulating means 7. That is, as shown in FIG. 1, a flow of the chemical solution 20 is generated in the longer direction of the oil separating apparatus 3 main body (i.e., in the direction of the dash arrows in FIG. 1) at the bottom of the oil separating apparatus 3 main body by bypassing the circulating means 7 and introducing the chemical solution 20 into the bottom of the oil separating apparatus 3 main body through the conduit 12, and returning the introduced chemical solution 20 to the circulating means 7 from the oil separating apparatus 3 main body through the conduit 14.

The heating means 8 is means for heating the chemical solution 20 stored in the oil separating apparatus 3 main body. The heating means 8 may be, for example, an electric heater or the like. Heating the chemical solution 20 stored in the oil separating apparatus 3 main body at a predetermined temperature by the heating means 8 promotes the rising of the oil in the chemical solution 20 to the surface of the chemical solution 20.

In this way, the oil separating apparatus 3 stores the chemical solution 20 that carries inclusions of oil and impurities that have been transferred from the sub tank 2*b* of the cleaning tank 2, as well as the chemical solution 20 introduced from the circulating means 7. The chemical solution 20 at the bottom of the oil separating apparatus 3 main body slowly flows in the longer direction of the oil separating apparatus 3 main body while being heated at the predetermined temperature by the heating means 8, and is thus kept there for a certain period of time (30 minutes in this example embodiment). At this time, the oil in the chemical solution 20 rises to the surface of the chemical solution 20, and this oil that has risen destroys the bubbles accumulated there (in particular, the bubbles accumulated at the surface of the chemical solution 20 in the second separating tank 3*b*), and as a result, the amount of bubbles decreases. That is, the oil separating apparatus 3 is able to remove the impurities in the cleaning tank 2 and the bubbles that include oil, while destroying the bubbles accumulated at the surface of the chemical solution 20 using the oil that rises when separating the oil from the chemical solution 20. In this way, the oil separating apparatus 3 separates the inclusions of oil and impurities from the chemical solution 20, discharges the separated inclusions of oil and impurities out of the system, and returns the chemical solution 20 that is free of oil and impurities to the circulating means 7.

Figure 2:
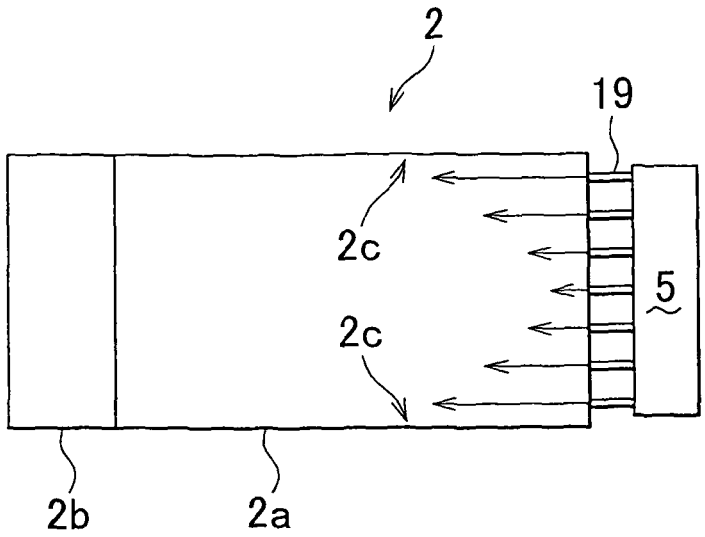
FIG. 2 is a view showing a frame format of a cleaning tank as viewed from above.

The surface flow generating means 5 is means for generating surface flow in the chemical solution 20 near the surface of the chemical solution 20 in order to remove bubbles that have risen to the surface of the chemical solution 20 in the main tank 2*a* of the cleaning tank 2 from the surface of the chemical solution 20. That is, the surface flow generating means 5 is means for generating surface flow in the chemical solution 20 near the surface of the chemical solution 20 in order to remove the bubbles that accumulate on the surface of the chemical solution 20 that has been stored for cleaning the body 10 in the main tank 2*a*. The surface flow generating means 5 includes a plurality of chemical solution supplying conduits 19 that are provided lined up in the shorter direction of the cleaning tank 2 at one end of the cleaning tank 2 in the longer direction, as shown in FIG. 2. Also, the surface flow generating means 5 is connected to the circulating means 7 via a conduit 15, such that the chemical solution 20 that has been introduced through the conduit 15 can be supplied to each of these chemical solution supplying conduits 19, and the amount (i.e., the flow mass) of the chemical solution 20 that is supplied from each of the chemical solution supplying conduits 19 to the main tank 2*a* of the cleaning tank 2 can be controlled individually. As a result, the surface flow generating means 5 supplies (i.e., delivers) the chemical solution 20 into the main tank 2*a* from each of the chemical solution supplying conduits 19 near the surface of the chemical solution 20 that is stored in the main tank 2*a*, while controlling the flow mass/flow rate of the chemical solution 20 that is being delivered. Accordingly, a surface flow can be generated such that the chemical solution 20 flows toward the sub tank 2*b* side and the pattern of the surface flow (i.e., the flow) can be appropriately controlled. In this example embodiment, the chemical solution 20 that is delivered from the chemical solution supplying conduits 19 is delivered such that the flow mass of the chemical solution 20 increases (i.e., the flow rate of the chemical solution 20 increases) from the center portion outward in the shorter direction of the cleaning tank 2, as shown in FIG. 2, and the pattern of the surface flow is set to facilitate the flow of bubbles near the side wall surfaces 2*c* and the corners on the surface flow generating means 5 side in the main tank 2*a* where bubbles tend to accumulate. Incidentally, in this example embodiment, the chemical solution 20 introduced into the chemical solution supplying conduits 19 is supplied from the circulating means 7, but the invention is not particularly limited to this mode. Alternatively, the chemical solution 20 may be directly introduced through a conduit from a predetermined location in the main tank 2*a* of the cleaning tank 2 (such as the bottom of the main tank 2*a*).

The microbubble supplying means 4 is means for supplying the chemical solution 20 that includes the microbubbles to the main tank 2*a* of the cleaning tank 2, and includes a microbubble generating device 4*a* that is means for generating the microbubbles, and a microbubble delivery conduit 4*b* that is a branch conduit that is connected to the microbubble generating device 4*a*. Also, the microbubble generating device 4*a* is connected to air supplying means, not shown, via the carbon dioxide removal device 6. One end of the microbubble delivery conduit 4*b* is connected to one end of the microbubble generating device 4*a*. The other end of the microbubble delivery conduit 4*b* branches off into a plurality of branch pipes, as shown in FIG. 1. These branch pipes are communicated to a plurality of locations on the inner wall surface of the main tank 2*a*. The end portion of each of these branch pipes is a microbubble delivery port 4*c* for delivering microbubbles.

These microbubble delivery ports 4*c* are densely arranged on the inner wall surface of the main tank 2*a* near the area where the body 10 is immersed into (i.e., enters) the chemical solution 20 in the main tank 2*a* of the cleaning tank 2, and delivers the chemical solution 20 that includes the microbubbles supplied by the microbubble supplying means 4. That is, the body 10 is conveyed into the cleaning tank 2 by conveying means, not shown, so that becomes submerged in the chemical solution 20 in the main tank 2*a* of the cleaning tank 2, as shown in FIG. 1. The microbubble delivery ports 4*c* are densely arranged on the inner wall surface facing the rear portion of the body 10, as well as on the inner wall surfaces of the main tank 2*a* that face the left and right sides of the body 10 when the body 10 is immersed in the chemical solution 20. That is, the microbubble delivery ports 4*c* are densely arranged on the inner wall surface of the cleaning tank 2 near the area where the body 10 becomes submerged in the chemical solution 20 stored in the cleaning tank 2. In this way, the microbubble supplying means 4 can supply the chemical solution 20 that includes the microbubbles from the microbubble delivery ports 4*c* using the chemical solution 20 supplied from the circulating means 7 that will be described later, and air supplied from the air supplying means. In particular, when the front of the body 10 is immersed in the chemical solution 20 (i.e., when the body 10 enters the tank, and thus the chemical solution 20 in the main tank 2*a*), the chemical solution 20 that includes a high concentration of microbubbles can be supplied to the body 10 from the microbubble delivery ports 4*c*.

The carbon dioxide removal device 6 is means for removing carbon dioxide from the air used to generate the microbubbles by the microbubble generating device 4*a* of the microbubble supplying means 4. A device configured to remove carbon dioxide by introducing air into an alkaline solution for removing carbon dioxide to cause bubbling, for example, may be used as the carbon dioxide removal device 6.

The circulating means 7 is means for circulating the chemical solution 20 by returning the chemical solution 20 from which oil has been separated by the oil separating apparatus 3 and returning this chemical solution 20 to the main tank 2*a* of the cleaning tank 2 again. The circulating means 7 includes a conduit 16 that connects the lower portion of the sub tank 2*b* to the upstream side end portion of the microbubble generating device 4*a*, and a pump 17 and heat exchanger 18 arranged in the conduit 16. Also, the oil separating apparatus 3 is bypass-connected on the upstream side of the motor 17 in the conduit 16 via the conduit 12 and the conduit 14, such that the chemical solution 20 from which oil has been removed by the oil separating apparatus 3 is returned to the circulating means 7 as described above. The heat exchanger 18 is able to heat the chemical solution 20 carried by the conduit 16 to a predetermined temperature. In this way, the circulating means 7 is able to circulate the chemical solution 20 by driving the pump 17 to transfer the chemical solution 20 stored in the sub tank 2*b* and the chemical solution 20 from which oil has been removed by the oil separating apparatus 3 to the microbubble generating device 4*a*, while heating the chemical solution 20 with the heat exchanger 18. Incidentally, the heat exchanger 18 need only be provided if the circulated chemical solution 20 needs to be heated.

Next, the cleaning process for cleaning the body 10 using the cleaning system 1 structured as described above will be described.

First, the body 10 is conveyed to a position above the cleaning tank 2 of the cleaning system 1 by the conveying means. Then the body 10 is lowered so that it becomes submerged in the chemical solution 20. In the cleaning tank 2, the chemical solution 20 that includes microbubbles is delivered by the microbubble generating device 4*a* via the microbubble delivery ports 4*c*. The microbubbles flow together with the chemical solution 20 onto the surface of the body 10 and into internal portions of the body 10 (such as members having a pouch structure, i.e., pouch-structured portions). Oil adhered to the body 10 and impurities such as dirt components become incorporated into the bubbles and thus removed. Then, the bubbles with the oil and impurities mixed in rise to the surface of the chemical solution 20 stored in the main tank 2*a*.

Also, during the cleaning process of the body 10, the bubbles that include the oil and impurities and that accumulate on the surface of the chemical solution 20 stored in the main tank 2*a* are made to overflow from the end portion of the main tank 2*a* and flow into the sub tank 2*b* by driving the surface flow generating means 5. Also, when removing the bubbles that accumulate on the surface of the chemical solution 20 in the main tank 2*a*, the surface flow generating means 5 may deliver the chemical solution 20 such that the flow rate increases from the center portion outward in the shorter direction of the cleaning tank 2, as shown in FIG. 2. Controlling the surface flow by the surface flow generating means 5 in this way makes it possible to make the bubbles that accumulate near the side wall surfaces 2*c* of the main tank 2*a* and the bubbles that accumulate in the corners on the surface flow generating means 5 side of the main tank 2*a* to efficiently flow toward the sub tank 2*b*, thereby making it possible to reduce the accumulation of bubbles.

Continuing on, the bubbles that have collected in the sub tank 2*b* as a result of overflowing from the main tank 2*a* accumulate on the surface of the chemical solution 20 in the sub tank 2*b*. These bubbles therefore are transferred together with a portion of chemical solution 20 that is near the surface of the chemical solution 20 toward the first separating tank 3*a* of the oil separating apparatus 3 by the pump 9. The chemical solution 20 that has been transferred from the sub tank 2*b* is kept in the oil separating apparatus 3 for a predetermined period of time while being heated, such that the oil in the chemical solution 20 rises to the surface of the chemical solution 20. Furthermore, the bubbles that have accumulated on the chemical solution 20 stored in the first separating tank 3*a* overflow to the second separating tank 3*b*. In the second separating tank 3*b*, the oil rises as a result of the chemical solution 20 being held for the predetermined period of time, and this oil combines with the bubbles accumulated on the surface of the chemical solution 20 (when the oil that has risen combines with the accumulated bubbles, the accumulated bubbles decrease as a result of the defoaming effect of the oil). The bubbles that include the oil and impurities and that have accumulated in the second separating tank 3*b* then overflow to the upper tank 24 of the third separating tank 3*c*, and the bubbles that include the oil and impurities that have accumulated in the upper tank 24 are then discharged out of the system via the conduit 13.

Also, the circulating means 7 circulates the chemical solution 20 by driving the pump 17 to transfer the chemical solution 20 stored in lower portion of the sub tank 2*b* and the chemical solution 20 from which oil has been removed by the oil separating apparatus 3 to the microbubble generating device 4*a*, while heating the chemical solution 20 to a predetermined temperature by the heat exchanger 18. In the microbubble generating device 4*a*, the chemical solution 20 that includes the microbubbles is adjusted by the chemical solution 20 transferred by the pump 17 and the air from which carbon dioxide has been removed by the carbon dioxide removal device 6, and then delivered from the plurality of microbubble delivery ports 4*c* toward the immersed body 10.

The plurality of microbubble generating devices 4*a* are densely provided on the inner wall surface of the main tank 2*a* near the area where the body 10 is submerged into (i.e., enters) the stored chemical solution 20 as it is lowered from above the main tank 2*a* of the cleaning tank 2 (i.e., near the tank entrance where the body 10 becomes submerged in the main tank 2*a*). As a result, when the body 10 is submerged into the chemical solution 20, a high concentration of microbubbles can be added into the chemical solution 20 that first flows into portions in the structure of the body 10 that the chemical solution 20 has difficulty getting into, so the cleaning performance at portions that the chemical solution 20 has difficulty getting into can be improved. More specifically, there are many areas in the structure of the body 10 that have a pouch structure that are portions of the body 10 that the chemical solution 20 has difficulty getting into. Once chemical solution 20 flows into these places, the chemical solution 20 there almost never changes during the cleaning process. Therefore, densely providing the microbubble delivery ports 4*c* at the tank entrance as described in this example embodiment makes it possible to add a high concentration of microbubbles into the chemical solution 20 that will initially flow into such a pouch structure, thereby enabling the cleaning performance at pouch-structured portions to be improved. As described above, the cleaning system 1 according to this example embodiment can improve the cleaning performance when cleaning the body 10 by adding microbubbles. Moreover, the chemical solution 20 can be circulated by the circulating means 7 and used again.

Figure 3:
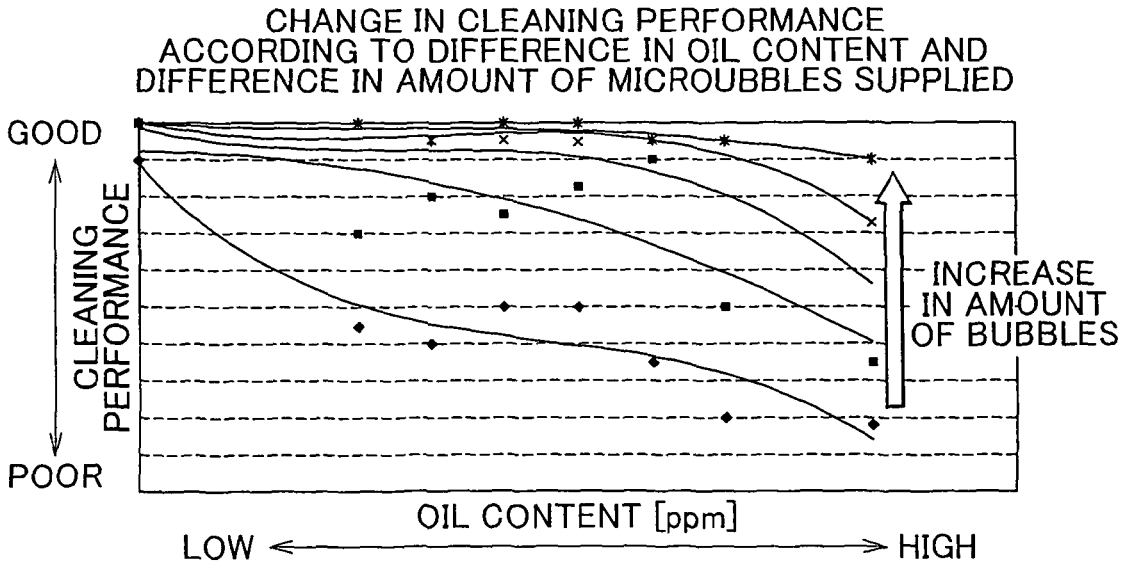
FIG. 3 is a graph of a change in cleaning performance according to a difference in the amount of microbubbles supplied and a difference in the oil content.

The graph in FIG. 3 shows a change in the cleaning performance (at pouch-structured portions) according to a difference in the oil content and a difference in the amount of microbubbles (MB) that are supplied in the cleaning system 1. In this graph, the horizontal axis represents the oil content [ppm] and the vertical axis represents the cleaning performance from poor to good. The plurality of curves in FIG. 3 show, in order from the bottom, cases in which the amount of microbubbles that are supplied (i.e., the amount of bubbles) has been increased. As shown by the upward facing arrow in FIG. 3, when the amount of microbubbles that are supplied is increased, the cleaning performance at pouch-structured portions of the body 10 that the chemical solution 20 has difficulty getting into improves. Also, as is evident from FIG. 3, the cleaning performance decreases as the oil content increases. However, when the amount of microbubbles that are supplied is increased, sufficient cleaning performance can be obtained even if the oil content is high. Thus, it is confirmed that having the chemical solution 20 that includes a high concentration of microbubbles flow into the pouch-structured portions of the body 10, i.e., the portions that the chemical solution 20 has difficulty getting into, when the body 10 is submerged into the chemical solution 20 is effective for cleaning performance.

Figure 4:
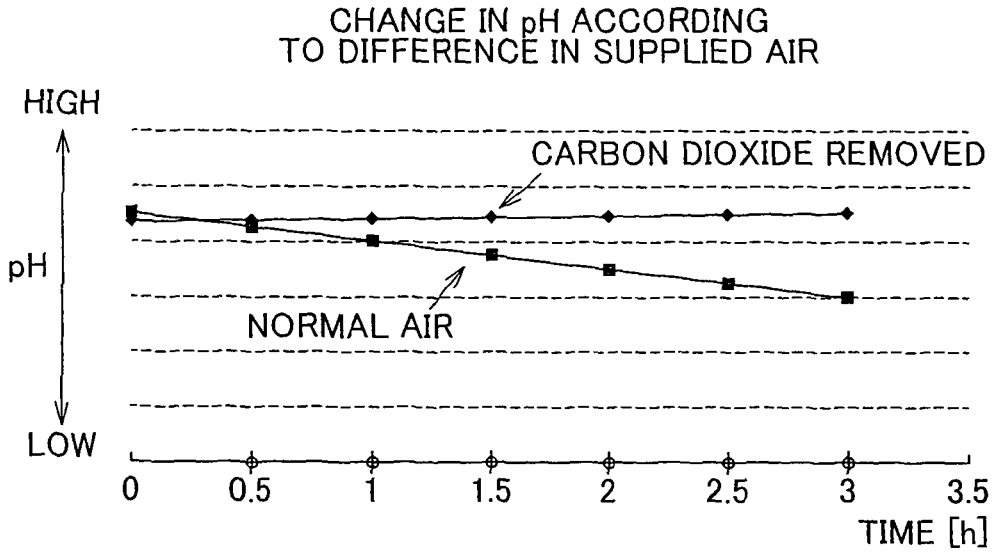
FIG. 4 is a graph of a change in pH according to a difference in the supplied air.

Next, the graph in FIG. 4 shows a change in the pH according to the presence or absence of carbon dioxide. The results shown were obtained from a test assuming a mixture of air and the chemical solution 20 in the microbubble generating device 4*a*. The change in the pH was measured over time with a case in which normal air was supplied to the chemical solution 20, as is the done in the related art, and with a case in which air from which carbon dioxide had been removed was supplied to the chemical solution 20. In this graph, the horizontal axis represents time [h] and the vertical axis represents the pH. In FIG. 4, the straight line that connects the solid black diamonds plotted on the graph represents the case with the air from which carbon dioxide has been removed, and the straight line that connects the solid black squares plotted on the graph represents the case with the normal air. As is evident from FIG. 4, with the normal air that includes carbon dioxide, the pH drops over time. This is because the chemical solution 20 that is alkaline ends up oxidizing. From these results, it is evident that removing the carbon dioxide from the air that is supplied to the microbubble generating device 4*a*, as is done in this example embodiment, keeps the pH of the chemical solution stored in the main tank 2*a* from changing, and thus enables the cleaning performance of the chemical solution 20 to be maintained.

Figure 5:
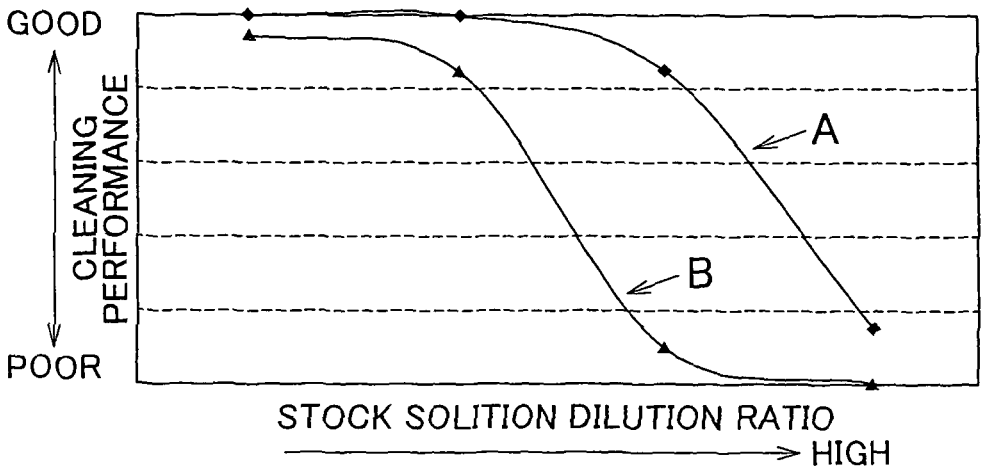
FIG. 5 is a graph of a change in cleaning performance according to agent dilution when adding microbubbles.

Next, the graph in FIG. 5 shows a change in the cleaning performance according to agent dilution when adding microbubbles. In this graph, the horizontal axis represents the stock solution dilution ratio, and the vertical axis represents the cleaning performance. In FIG. 4, the curve that connects the solid black diamonds plotted on the graph shown by arrow A represents a case in which microbubbles were added, and the curve that connects the solid black triangles plotted on the graph shown by arrow B represents a case in which microbubbles were not added. In this graph, cleaning performance can be sufficiently ensured even if the cleaning agent is diluted, by improving the cleaning performance by adding microbubbles, as is evident when comparing the difference between the case in which microbubbles were added and the case in which microbubbles were not added. Furthermore, with the cleaning system 1 according to this example embodiment, carbon dioxide is removed from the air that is supplied to the microbubble generating device 4*a*, so even if the chemical solution 20 continues to be circulated and used again, the pH of the chemical solution 20 will not change, so the cleaning performance of the chemical solution 20 can be maintained. As a result, sufficiently cleaning performance can continue to be obtained even with a highly diluted chemical solution, i.e., a chemical solution with a high dilution ratio.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. A microbubble cleaning system for cleaning a large product, comprising:

a cleaning tank in which a chemical solution into which the product is immersed to clean the product is stored;

a microbubble supplying device that puts microbubbles into the chemical solution and supplying the chemical solution that includes the microbubbles into the cleaning tank;

an oil separating apparatus that collects bubbles that have risen to a surface of the chemical solution stored in the cleaning tank as a result of cleaning the product, as well as a portion of the chemical solution that is near the surface of the chemical solution, in order to separate oil from the chemical solution;

a surface flow generating device that generates a surface flow of the chemical solution near the surface of the chemical solution in order to remove the bubbles that have risen to the surface of the chemical solution in the cleaning tank; and a carbon dioxide removing device that removes carbon dioxide from air that is used to generate the microbubbles by the microbubble supplying device.

2. The cleaning system according to claim 1, further comprising a circulating device that circulates the chemical solution by returning the chemical solution from which oil has been separated by the oil separating apparatus to the cleaning tank again.

3. The cleaning system according to claim 1, wherein a plurality of delivery ports that supplies the chemical solution that includes the microbubbles by the microbubble supplying device are densely provided on an inner wall surface of the cleaning tank in a location near a portion where the product is submerged into the stored chemical solution.

4. The cleaning system according to claim 1, wherein the surface flow generating device supplies the chemical solution into the cleaning tank in a manner such that a portion of the chemical solution that is near the surface of the chemical solution flows toward the oil separating apparatus side.

5. The cleaning system according to claim 1, wherein the surface flow generating device controls a flow rate of the chemical solution that is supplied so as to increase from a center portion outward in a transverse direction of the cleaning tank.

* * * * *